US008590199B2

(12) United States Patent
Overstreet et al.

(10) Patent No.: US 8,590,199 B2
(45) Date of Patent: Nov. 26, 2013

(54) MODIFIED BOLT ASSEMBLY WITH FORWARD ASSIST ADAPTOR FOR ACCOMODATING SUB CALIBER AMMUNITION UTILIZED IN AN AR-15 TYPE FIREARM

(75) Inventors: John L. Overstreet, Fayette, MO (US); Charles C. Kelly, Kirksville, MO (US)

(73) Assignee: 22 Evolution LLC, Columbia, MO (US)

( * ) Notice: Subject to any disclaimer, the term of this patent is extended or adjusted under 35 U.S.C. 154(b) by 394 days.

(21) Appl. No.: 13/069,930

(22) Filed: Mar. 23, 2011

(65) Prior Publication Data

US 2011/0252957 A1 Oct. 20, 2011

Related U.S. Application Data

(60) Provisional application No. 61/324,482, filed on Apr. 15, 2010.

(51) Int. Cl.
*F41A 3/12* (2006.01)

(52) U.S. Cl.
USPC ..... 42/69.02

(58) Field of Classification Search
USPC ..... 42/14, 16, 25, 69.02, 106; 89/186, 199, 89/17
See application file for complete search history.

(56) References Cited

U.S. PATENT DOCUMENTS 3,656,250 A 4/1972 Brown
3,776,095 A * 12/1973 Atchisson ..... 89/128
4,057,003 A 11/1977 Atchisson
4,058,922 A 11/1977 Elbe et al.
4,069,608 A 1/1978 Jurek
4,098,016 A * 7/1978 Foote ..... 42/16
4,142,314 A * 3/1979 Foote ..... 42/16
4,169,329 A 10/1979 Atchisson
4,194,314 A * 3/1980 Foote ..... 42/25
4,220,071 A 9/1980 Seiderman
4,231,177 A * 11/1980 Foote ..... 42/16
4,515,064 A 5/1985 Hohrein
4,531,446 A 7/1985 VanVoorhees
4,617,749 A 10/1986 Jurek
4,648,192 A 3/1987 Harness
4,907,362 A 3/1990 Hobbie
4,920,678 A 5/1990 Brown (Continued)

OTHER PUBLICATIONS

US Statutory Invention Registration No. H926, Published Jun. 4, 1991, entitled "Rimfire Blank Adaptor Kit for M16 Rifles", Inventor: Raymond A. Mahtook, Assignee: The United States of America as represented by the Secretary of the Army.

*Primary Examiner* — Benjamin P Lee
(74) *Attorney, Agent, or Firm* — Gifford, Krass, Sprinkle, Anderson & Citkowski, P.C.; Douglas J. McEvoy

(57) ABSTRACT

A sub caliber action device installable within an upper receiver of an AR-15 type firearm which interfaces with an upper receiver mounted forward assist for use with such as .22 caliber ammunition. The device includes a generally elongated receiver plate exhibiting a generally lengthwise extending notched interior established between extending sides, with the notched interior seating a bolt and a forward assist adaptor in reciprocating fashion along the receiver plate between an end-most location and a forward secured chamber adaptor. The adaptor is reconfigurable to inertially and linearly displace a limited distance relative to the bolt support sleeve during full auto firing mode and which influences the bolt against the chamber adaptor during striking of the bolt supported firing pin by the hammer.

14 Claims, 17 Drawing Sheets

(56) References Cited

U.S. PATENT DOCUMENTS

| | | | | |
|---|---|---|---|---|
| 4,955,157 | A | 9/1990 | Brighton et al. | |
| 5,046,275 | A | 9/1991 | Brown | |
| 5,551,179 | A | 9/1996 | Young | |
| 6,070,352 | A | 6/2000 | Daigle | |
| 6,293,040 | B1 | 9/2001 | Luth | |
| 6,625,916 | B1 * | 9/2003 | Dionne | 42/16 |
| 6,715,396 | B2 | 4/2004 | Dionne | |
| 7,219,462 | B2 | 5/2007 | Finn | |
| 7,302,881 | B1 | 12/2007 | Tertin | |
| 7,444,775 | B1 | 11/2008 | Schuetz | |
| 7,631,453 | B2 | 12/2009 | Longueira | |
| 7,735,409 | B1 | 6/2010 | Tertin | |
| 7,784,211 | B1 | 8/2010 | Desomma | |
| D626,618 | S | 11/2010 | Peterson et al. | |
| 7,938,055 | B2 | 5/2011 | Hochstrate et al. | |
| 7,971,379 | B2 | 7/2011 | Robinson et al. | |
| 7,971,382 | B2 | 7/2011 | Robinson et al. | |
| 8,316,755 | B2 * | 11/2012 | Overstreet et al. | 89/179 |
| 8,387,513 | B2 * | 3/2013 | Gomez et al. | 89/191.01 |
| 2006/0037464 | A1 | 2/2006 | Moore | |
| 2010/0000396 | A1 | 1/2010 | Brown | |
| 2011/0252685 | A1 * | 10/2011 | Overstreet et al. | 42/16 |
| 2011/0277368 | A1 * | 11/2011 | Overstreet et al. | 42/108 |
| 2012/0005931 | A1 * | 1/2012 | Kelly et al. | 42/14 |
| 2012/0137869 | A1 * | 6/2012 | Gomez et al. | 89/125 |
| 2012/0152105 | A1 * | 6/2012 | Gomez et al. | 89/191.01 |
| 2012/0174451 | A1 * | 7/2012 | Overstreet et al. | 42/16 |

* cited by examiner

MODIFIED BOLT ASSEMBLY WITH FORWARD ASSIST ADAPTOR FOR ACCOMODATING SUB CALIBER AMMUNITION UTILIZED IN AN AR-15 TYPE FIREARM

CROSS-REFERENCE TO RELATED APPLICATIONS

This application claims the benefit of U.S. Provisional Application 61/324,482 filed on Apr. 15, 2010.

FIELD OF THE INVENTION

The present invention discloses an upper receiver installable sub caliber action device including a modified bolt assembly and further incorporating a forward assist adaptor for use with such as an AR-15 type firearm. The adaptor works in combination with the forward assist and associated bolt assembly to adapt the firearm for use with sub caliber ammunition, such as .22 caliber ammunition in either drop in or dedicated variants.

BACKGROUND OF THE INVENTION

The forward assist on an M16 or AR-15 type rifle is a button, usually located near the bolt closure that, when actuated, will push an associated bolt carrier forward, ensuring that the bolt is locked and to assist in forcing a round into the battery in the event of the bolt not fully closing. In order to ensure that an associated extractor component is clipped around the rim of the shell, the forward assist is usually struck rather than pushed.

The forward assist is commonly incorporated into standard loading procedure to prepare a weapon for a life threatening situation, or to close the bolt when the weapon is excessively dirty. The forward assist can also be used to close a bolt that was gently let down, rather than being released under full spring compression, and in order to keep the noise of closing the bolt to a minimum.

In acknowledgement of the frequency with which a weapon jams when taken outside of the clean environment of the test range, the forward assist was implemented to save the operator the potential danger of aiming the rifle and pulling the trigger and the rifle not discharging the shell due to the bolt not being fully forward (a safety arrangement called a "safety sear" stopping the hammer from being released and the weapon firing, because of the dangers of firing with the bolt not fully closed).

SUMMARY OF THE INVENTION

The present invention discloses a sub caliber action device installable within an upper receiver of an AR-15 type firearm which interfaces with an upper receiver mounted forward assist for use with such as .22 caliber ammunition. The device includes a generally elongated receiver plate exhibiting a generally lengthwise extending notched interior established between extending sides, with the notched interior seating a bolt and a forward assist adaptor in reciprocating fashion along the receiver plate between an end-most location and a forward secured chamber adaptor.

The bolt further includes a rearward projecting sleeve including an open interior for receiving and seating an opposing guide rod associated with a further mounting location of said receiver plate and in order to maintain in assembled fashion said forward assist adaptor. The forward assist adaptor further includes a generally semi-circular cross sectional shape with a plurality of scales along an extending side in communication with a forward engaging pawl of the forward assist. The adaptor and bolt can further be configured for both drop in (retrofit) and dedicated variants and the receiver plate can further be designed to include a plurality of protrusions defined along a notched interior for seating the bolt and the assist adaptor.

A further revised version of the adaptor incorporates a rear slotted location which is in communication with a rearward most underside location of the outer support associated with the main action coil spring. The adaptor operates as previously disclosed in single and semi automatic firing however, in the event of fully automatic firing, this reconfiguration causes the adaptor to operate as an anti-bounce component by influencing the bolt in a forward closed position to ensure that the associate striking of the hammer against the bolt integrated firing pin. The anti-bounce function designed into the adaptor is accordingly a useful feature when the weapon operates under full automatic firing mode, and during which the .22 bolt would otherwise tend to bounce open during its repetitive cycling.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Referring now to the following illustrations, the present invention discloses an upper receiver installable sub-caliber action, again for both drop-in and dedicated variants and including a modified bolt assembly and forward assist adaptor for use with such as an AR-15 type firearm and which enables the incorporation of a modified adaptor incorporated into the bolt which interfaces with the upper receiver mounted forward assist for use with .22 caliber ammunition. In this fashion, the forward assist is capable of being manipulated to fully seat an ammunition round in the event of the bolt not fully closing, and such as is present when used with center fire ammunition.

Figure 1:
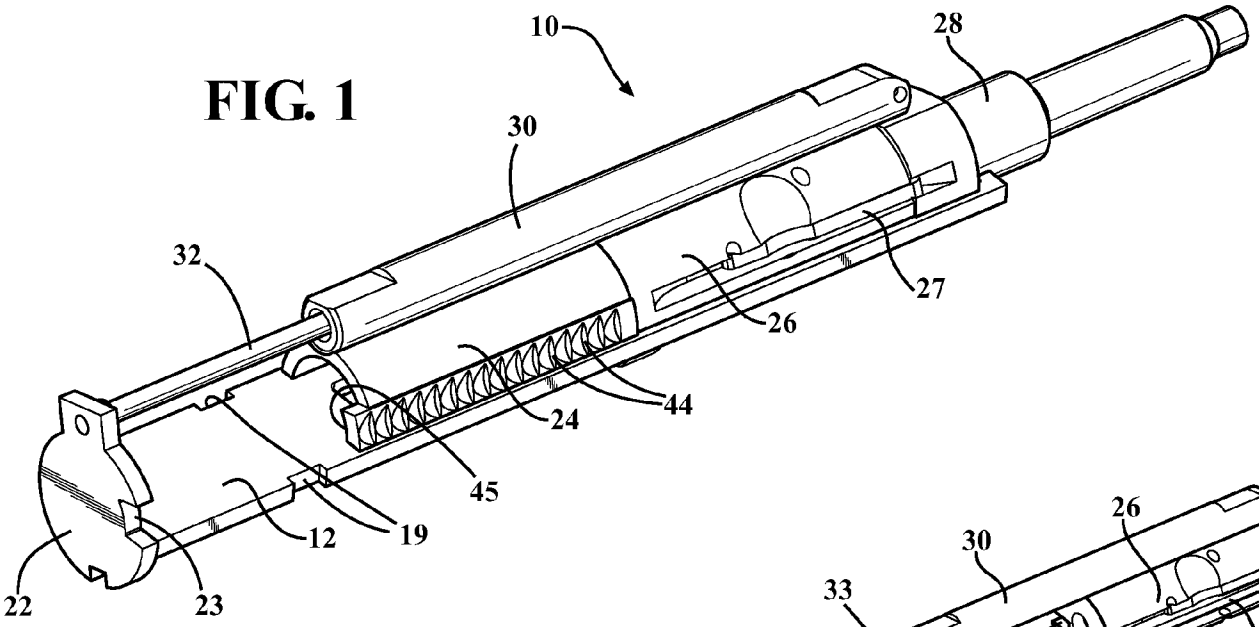
FIG. 1 is an assembled perspective of the forward assist sub caliber action device according to the invention.
Figure 2:
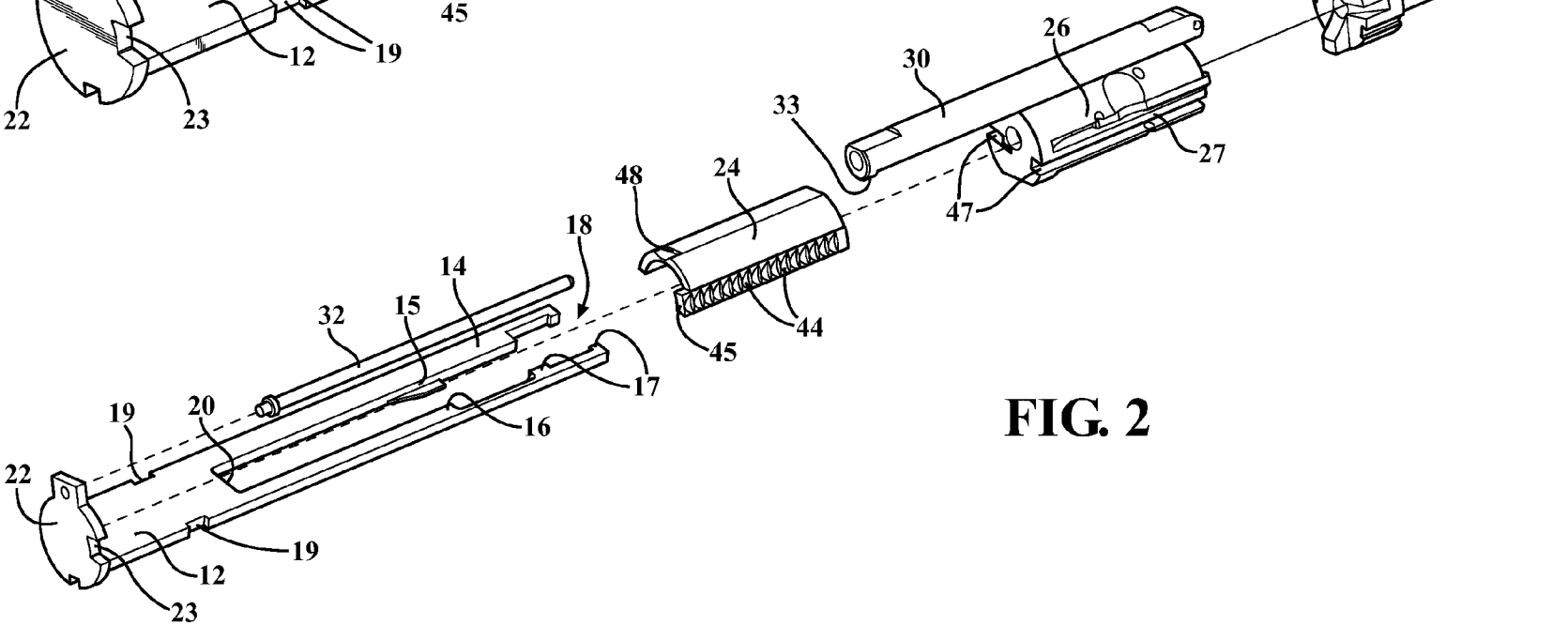
FIG. 2 is an exploded view of the sub caliber action device.

Referring to each of FIGS. 1 and 2, both assembled and exploded perspectives are shown of the forward assist sub caliber action device and which includes an adaptor bolt subassembly generally shown at 10 in FIG. 1. A generally elongated receiver plate is shown at 12 and exhibits a generally lengthwise extending notched or keyed interior, established between generally parallel extending sides 14 and 16 (see also inwardly facing protrusions 15 and 17, established along the notch for seating the various adapter and bolt components) a distance from an open end 18 to an intermediate location 20 short of an opposite end plate or support 22. Also depicted at 19 are a further smaller pair of notches extending along the sides of the receiver plate proximate the end support 22. The end support 22 further exhibits a side disposed interior notch, see as depicted at 23.

The notched interior is configured for seating the remaining components of the modified bolt assembly in a generally stacked and assembly fashion, these namely including each of a forward assist adaptor 24, a bolt assembly 26 with side disposed extractor 27, and a forward-most projecting chamber adaptor 28. The configuration of the bolt assembly 26 is further such that a rearward projecting support sleeve 30 includes an open interior for receiving and seating an opposing guide rod 32 associated with a further mounting location of the receiver plate 12 and in order to maintain in assembled fashion the adaptor bolt subassembly 10 (such as is known as a .22 caliber adaptor bolt).

Although not shown, a main action coil spring is positioned between the sleeve 30 and rod 32 to bias the bolt relative the receiver plate. Also shown at 33 in each of FIGS. 2, 17, and 18B-18D is a rear end underside protuberance associated with the sleeve 30, the purpose for which being to align with a corresponding recess location (see as subsequently referenced at 48) associated with the adaptor 24 (see as best shown in FIG. 2). As will be further described in reference to an alternate variant of assist adaptor (this integrating anti-bounce capability) disclosed in FIGS. 17 and 18, the underside protuberance 33 seats within a rear edge accessible and linearly extending recess channel or slot which is configured to permit the redesigned adapter to exhibit a necessary degree of linear movement or play to prevent the forwardly positioned bolt from unseating from the forward chamber adaptor 28 during full automatic firing mode.

As is also known, the bolt assembly is a mechanical part of the firearm upper receiver and which is seated within a barrel at a location in which it blocks a rear of the associated chamber during burning of the propellant. In semi-automatic firearms, such as is the case AR-15 type firearms, the bolt is caused to cycle back and forth during each cartridge discharge cycle, propelled by recoil/expanding gas (backwards) or spring recoil (forwards) via a forward extending gas port and an upper and rear extending/rerouting of a gas tube for utilizing the gas blowback to successively eject and reload (re-chamber) a succeeding round.

Upon moving back, the extractor 27 pulls a spent cartridge casing (not shown) from an attached magazine (not shown) and pushes it into a firearm chamber established between the upper and lower assembled receivers. Upon successive discharge, and once the spent shell casing case is clear of the chamber, an ejector component of the bolt ejects the casing from the receiver and out of the firearm (such as through a side window of the upper receiver which exposes the firing chamber.

As is further illustrated in the operational views of FIGS. 8-14 and the upper receiver views of FIGS. 15 and 16, brief reference will be made to specific and relevant operating components associated with the AR-15 firearm and in use with the modified bolt assembly 10, such as which is seated within a rear open end of the upper receiver portion (see as shown at 34 in FIG. 15) of the AR-15 firearm. Without further elaboration, additional existing and interfacing features associated with the upper receiver 34 include an underside accessible aperture defined in a lengthwise configured barrel portion (see enlarged underside view of FIG. 16) for receiving an associated lower receiver 36 (see FIG. 8) and communicating magazine, and within which is installed the reciprocating bolt subassembly 10.

Figure 10:
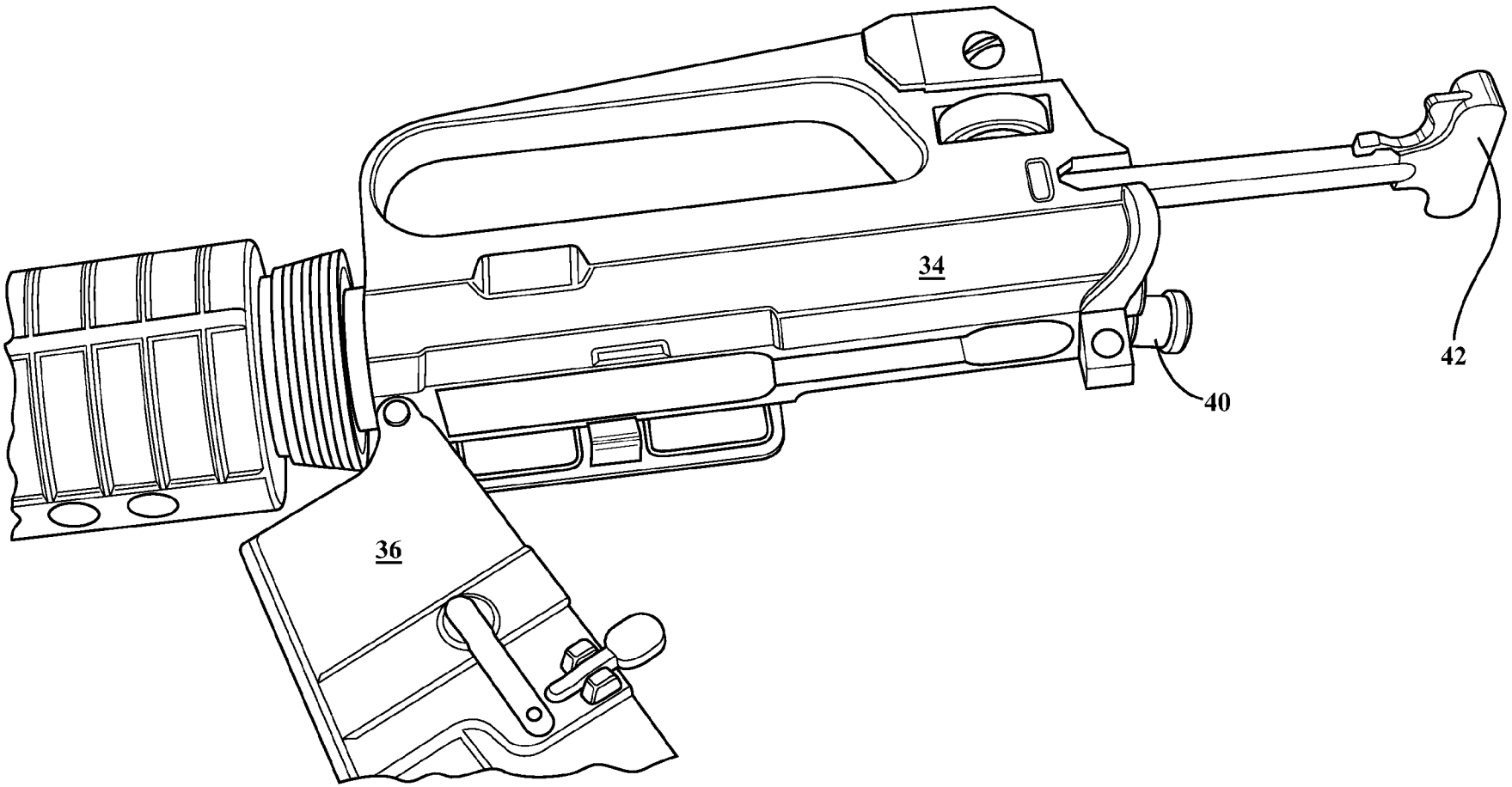
Figure 11:
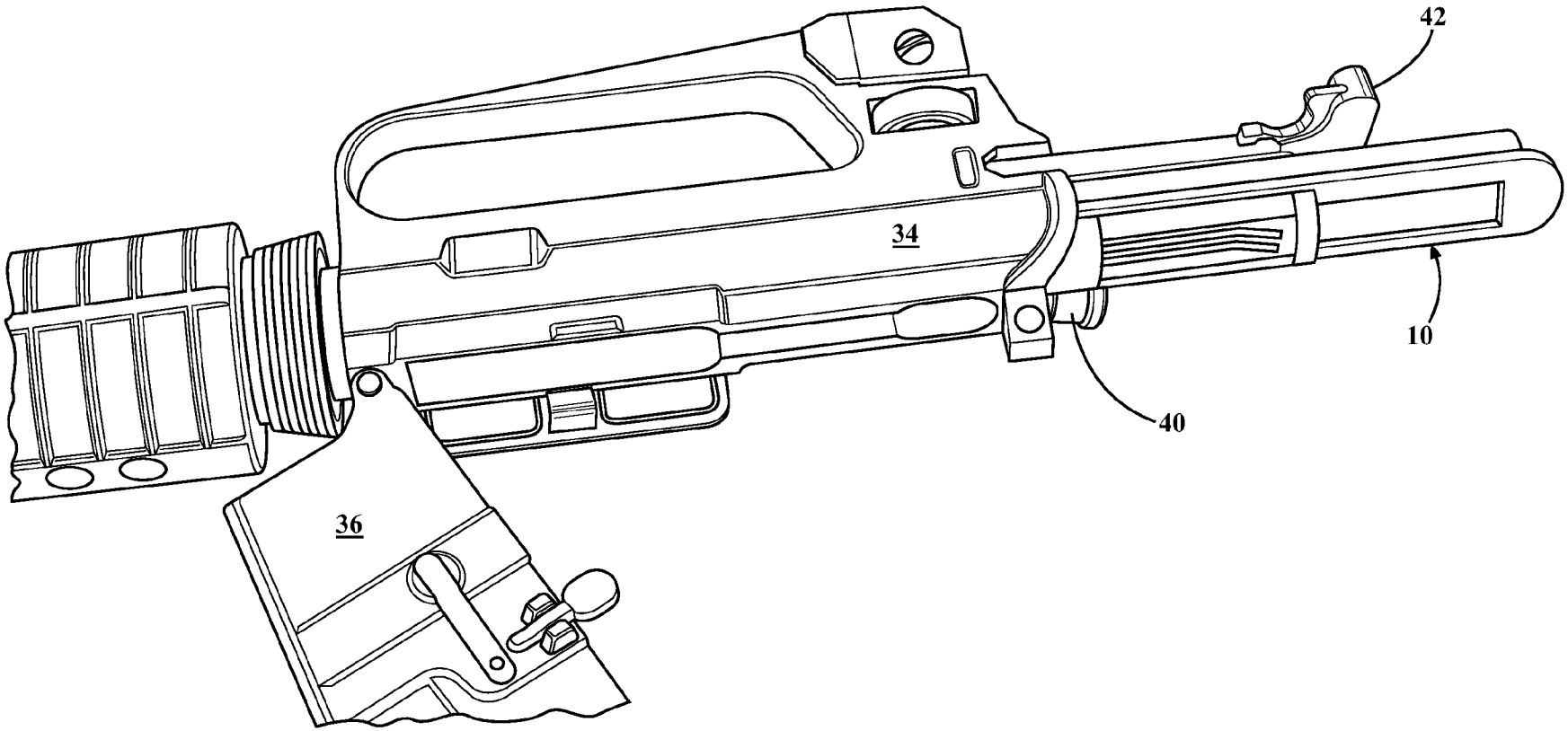
Figure 12:
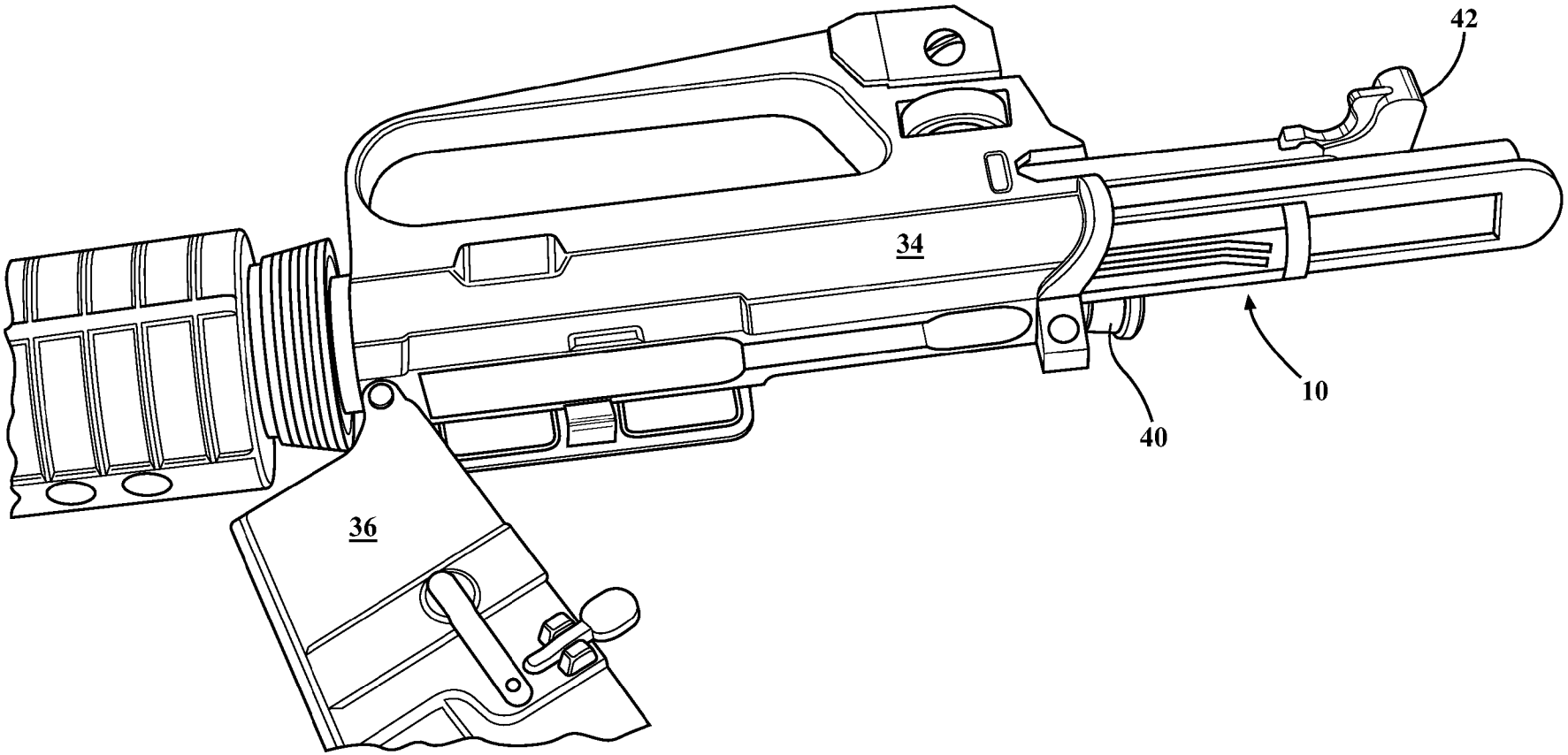
Figure 13:
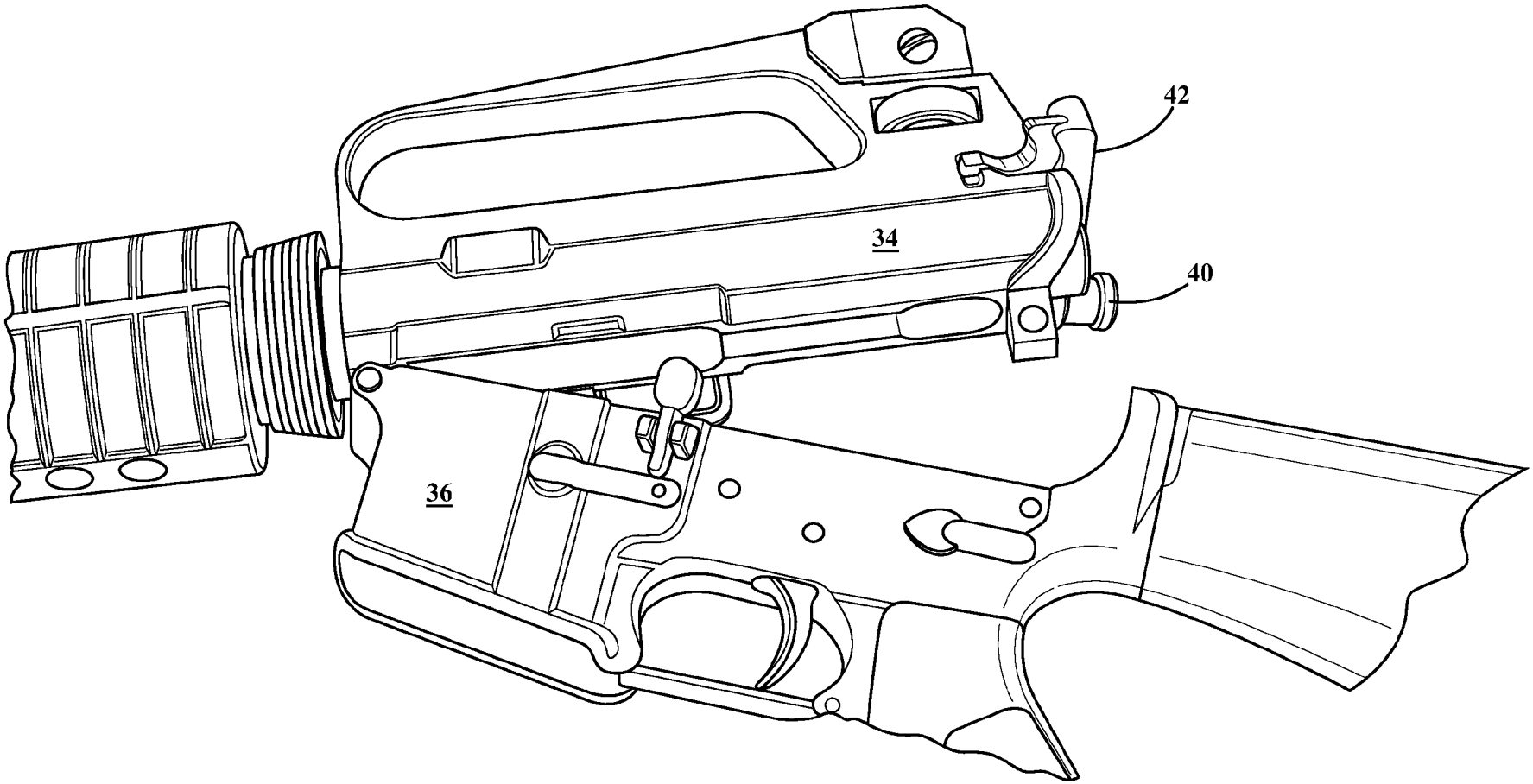

Additional existing features of the upper receiver 34 include the provision of a forward assist subassembly 38 mounted in angularly extending and integrated fashion into a rear housing location of the upper receiver 34 and which seats a forward assist plunger 40. Also shown at 42 in FIGS. 10 and 15 is a charging handle for assisting in seating, supporting and removing of the adaptor bolt assembly 10 within the upper receiver 34.

Figure 3B:
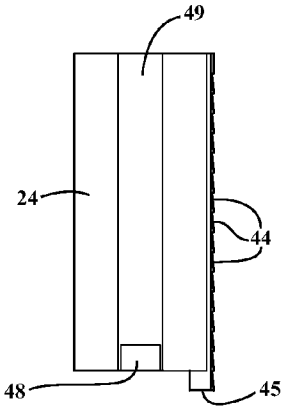
FIGS. 3A-3D illustrate a succession of perspective, top, right side and rear views of a forward assist adaptor component forming a component of the assembled sub caliber action device and in particular depicting its scaled side profile for engaging the forward assist at a number of length displacing locations defined along the adaptor.
Figure 3D:
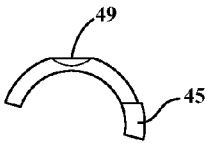
Figure 3A:
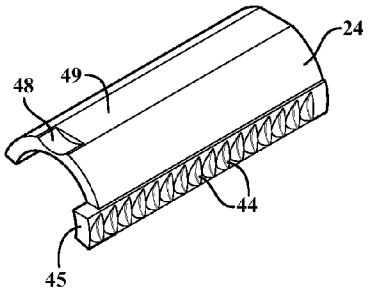
Figure 3C:
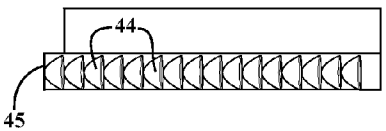
Figure 4:
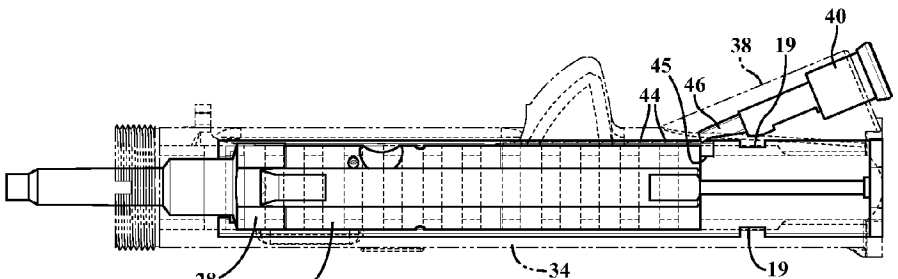
FIG. 4 is a top cutaway view illustrating the forward assist sub caliber action device mounted within an upper receiver portion of such as an AR-15 type firearm and including in enlarged detail an engagement feature of the adaptor component for engagement by the firearm forward assist component.

Referring now to each of FIGS. 3A-3D, illustrated are a succession of perspective, top, right side and rear views of the forward assist adaptor component 24 forming a component of the assembled sub caliber action device, and in particular depicting its scaled side profile, see plurality of side serrated edges 44, each of which as best shown in FIG. 4 is dimensioned for engaging a most forward extending pawl 46 (FIG. 4) associated with the forward assist plunger 40 at any location along an overall length of the adaptor 24. The dimensioning of the forward assist adaptor 24 is established at a minimum desired length mounted to a rear portion of the receiver plate 12 in contact with the bolt assembly 26. Also depicted at 47 is a rearward side extending protrusion associated with the forward assist adaptor 24 and which seats, in the most rearward displaced position of the adaptor 24 as depicted in FIG. 7, within the side notch 23 associated with the end plate 22.

The forward assist adaptor 24 is further depicted as a drop in unit which fits behind the bolt 26 and which rides on the rails (sides 14 and 16) established between the bolt and end-plate 12. In one non-limiting application, it is also envisioned that the adaptor can be integrated into a modified bolt 26 that is longer in length than shown while retaining lengthwise extending side disposed seating recesses/channels (see as shown at 47 in FIG. 2 located just below the ejector 27) for supporting in displace-ably seating fashion along the receiver plate 12.

Figure 6:
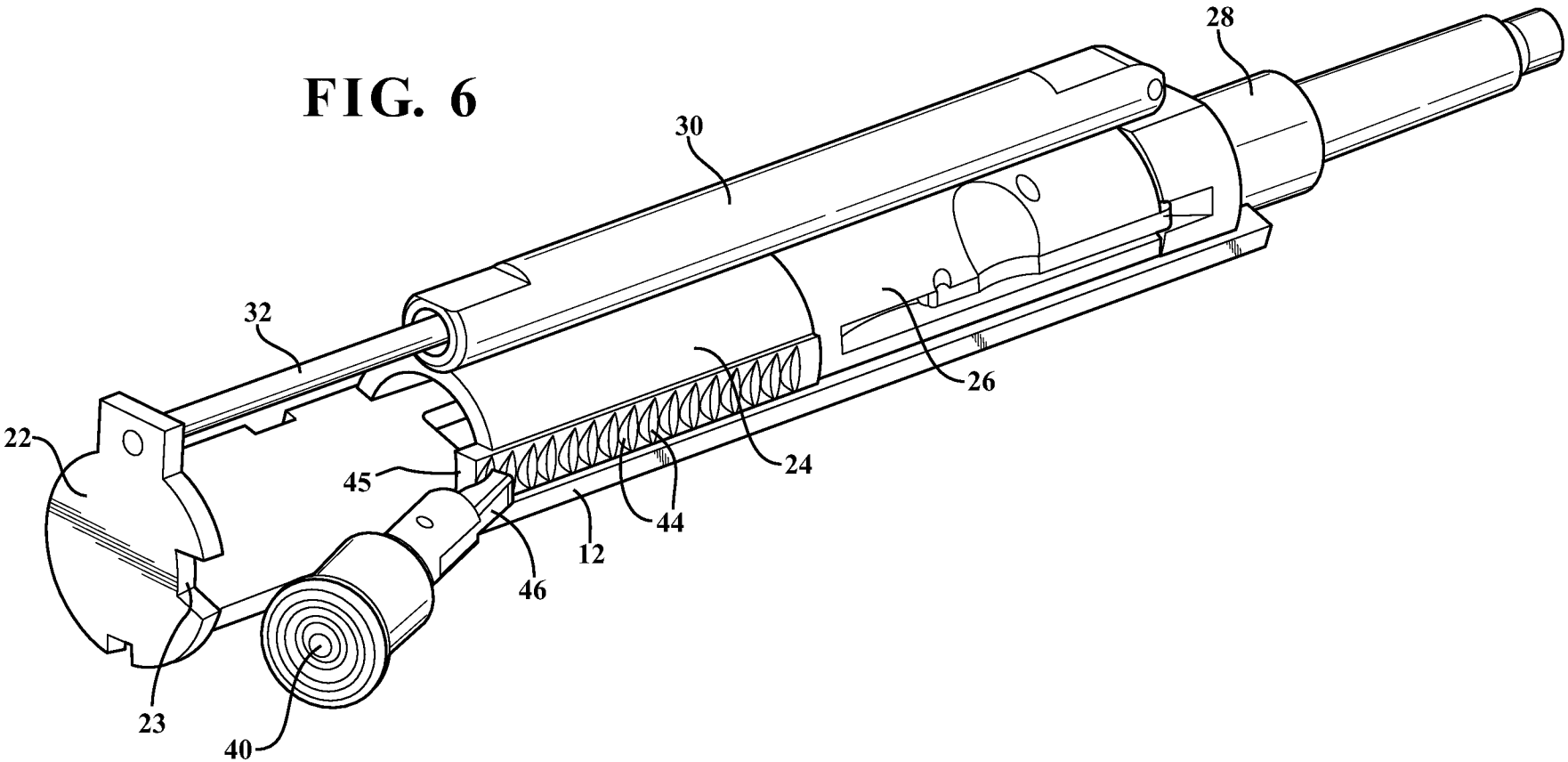
Figure 7:
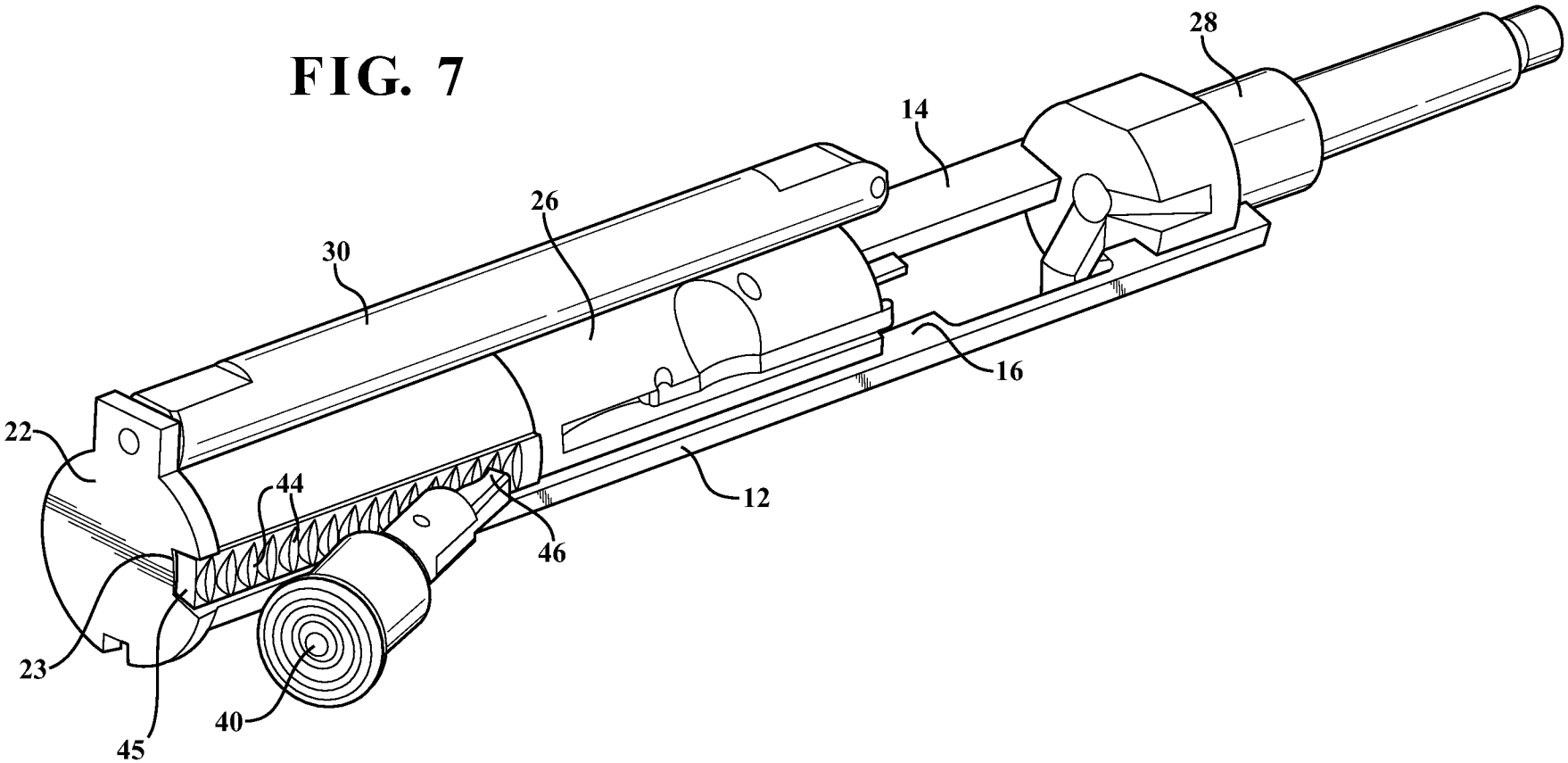
FIG. 7 is a succeeding view to each of FIGS. 5 and 6 and further showing the forward assist adaptor component and bolt retracted to a rearmost position abutting an end receiver plate of the assembly.
Figure 8:
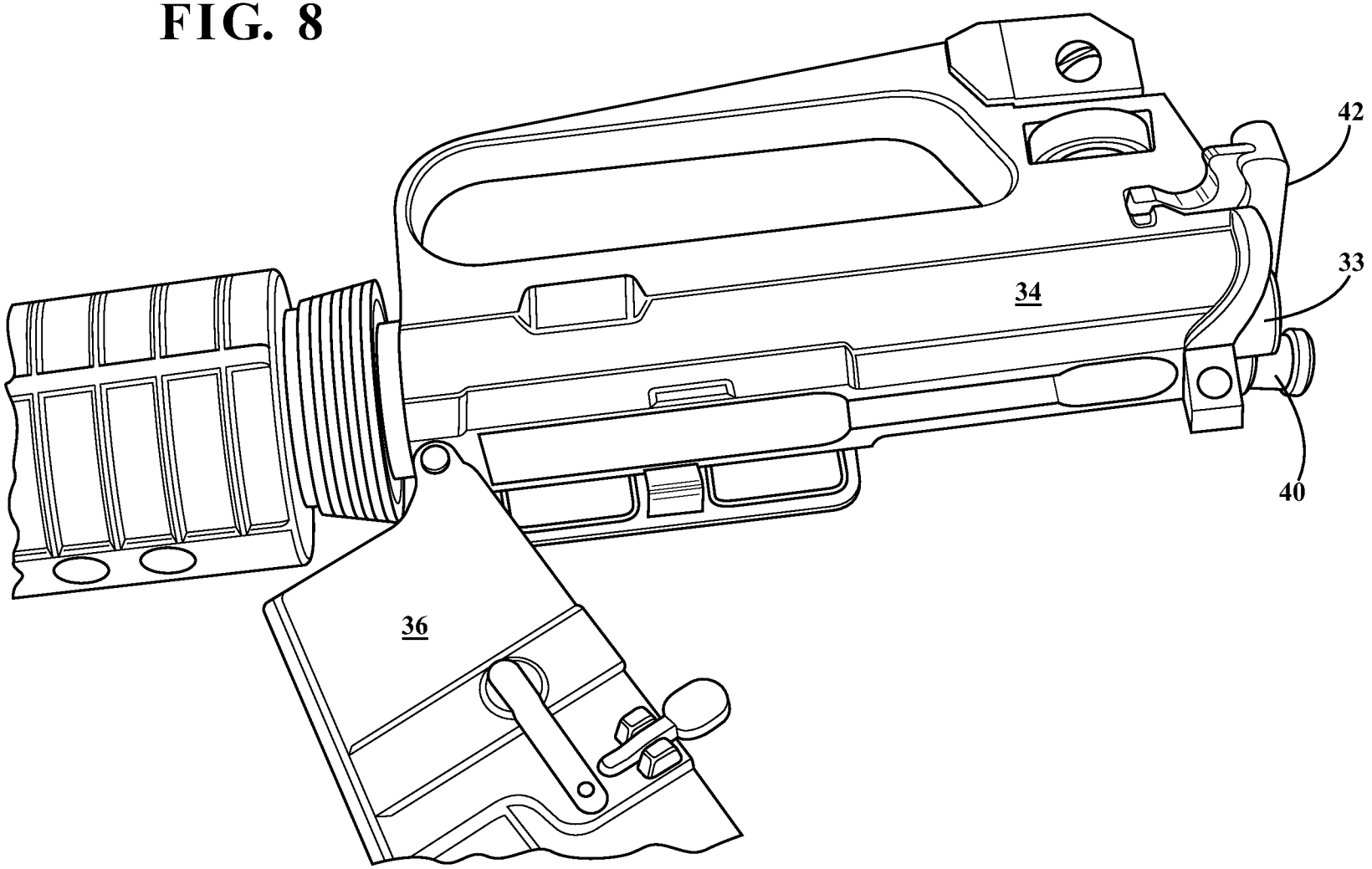
FIGS. 8-14 illustrate a succession of environmental views depicting the disassembly of the upper receiver from the lower receiver of an AR-15 style firearm, the removal of a conventional bolt assembly and substitution of the sub caliber action device into the upper receiver barrel, and subsequent reassembly of the upper receiver.

In this fashion, the adaptor 24 (which exhibits a generally semi-circular shape as shown in FIG. 3D exhibits a notched end location 48 which is contiguous with an upper length extending recess 49 in FIG. 3A) is supportably positioned under the rearward projecting sleeve 30 of the bolt 26 (such as again so that the underside protuberance associated with the rear of the sleeve 30 seats within the end notched location 48) in a fashion that permits it the bolt 26 and adaptor 24 to displace along the receiver plate as illustrated in FIGS. 6 and 7 (by virtue of the extending sleeve associated with the reciprocating bolt carrying there-along the adaptor in slaved fashion) and relative to a fixed end mounted arrangement established between the chamber adaptor 28 and the receiver plate 12. It is further understood that the adaptor/bolt can be configured for both drop in (retrofit) and dedicated variations within the scope of the invention.

FIG. 4 is a .22 cutaway view illustrating the forward assist sub caliber action device mounted within the upper receiver portion 34 of the AR-15 type firearm and including in enlarged detail an engagement feature of the adaptor component 24 for engagement by the firearm forward assist component (housing 38 supported plunger 40 with engagement pawl 46. In use, the forward assist plunger 40 is used to manually close the adaptor bolt assembly 10 and is, in this sense an "emergency" feature in that, such as in instances where the chamber gets dirty and/or if the action spring is a little older and less springy, the bolt may fail to close all the way.

As further depicted, the forward assist pushes on a selected location established along the plurality of side disposed ridges 44 exhibited on the forward assist adaptor 24, these again termed "fish scales" which are exhibited on the side of the bolt carrier for enabling the bolt to be fully pushed into the forward located chamber adaptor. As is further illustrated, the forward assist plunger 40 on the upper receiver is manipulated via a push button configuration found commonly on M16 and AR-15 styled rifles, and usually located near the bolt closure such that, when depressed, the plunger 40 will push the bolt carrier forward, ensuring that the bolt is locked. The forward assist can also be used to close a bolt that was gently let down, rather than released under full spring compression, such as in order to keep the noise of closing the bolt to a minimum.

In operation, the final degree of travel of the forward assist engages on the rear of the forward assist adaptor 24, rather than engaging with the fish scales. This is significant since the length that protrudes rearward to the end of the notch in the frame, but not past it, is critical. Other variants can render possible engagement of the fish scale on the final push, with a required lengthening of the protrusion well past the rear of the frame plate. The flush configuration of the adaptor 24 shown makes it unnecessary to remove the lower receiver buffer assembly.

In one non-limiting variant of the present design, an approximately ⅛" protruding off a rear of the forward assist adaptor 24 provides a sufficient length for establishing necessary contact between the forward assist 40 and adaptor 24 when the bolt is nearing a fully closed position and without travel past the end plate during compression of the main action spring between the bolt and receiver plate. In use, all .22 sub caliber ammunition is adapted for use with a similar end plate design, exhibiting the configuration of the notched and component supporting area established between the sides 14 and 16 of the plate 12.

Figure 5:
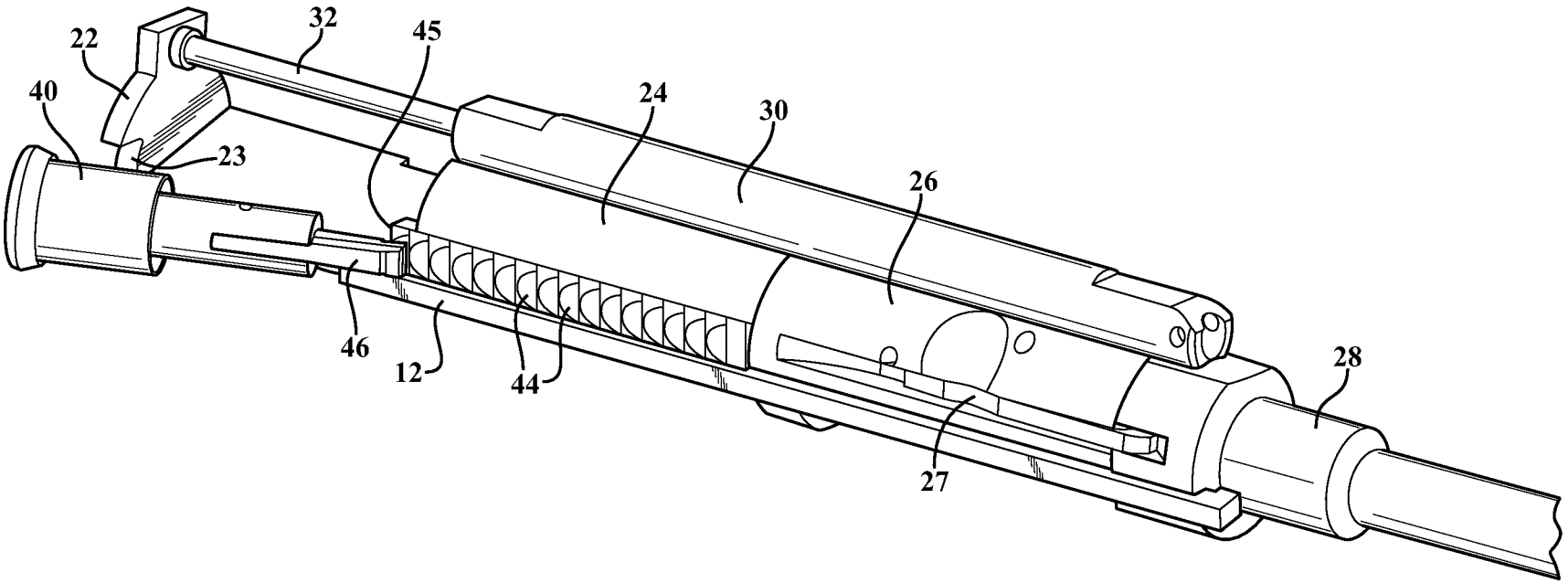
FIGS. 5 and 6 are a pair of perspective views of an assembled forward assist sub caliber action device substantially as depicted in FIG. 1.

As previously described, FIGS. 5 and 6 illustrate a pair of perspective views of an assembled forward assist sub caliber action device substantially as depicted in FIG. 1. FIG. 7 is a succeeding view to each of FIGS. 5 and 6 and further showing the forward assist adaptor component 24 and bolt 26 retracted to a rearmost position abutting the end support 24 of the end receiver plate 12.

Figure 9:
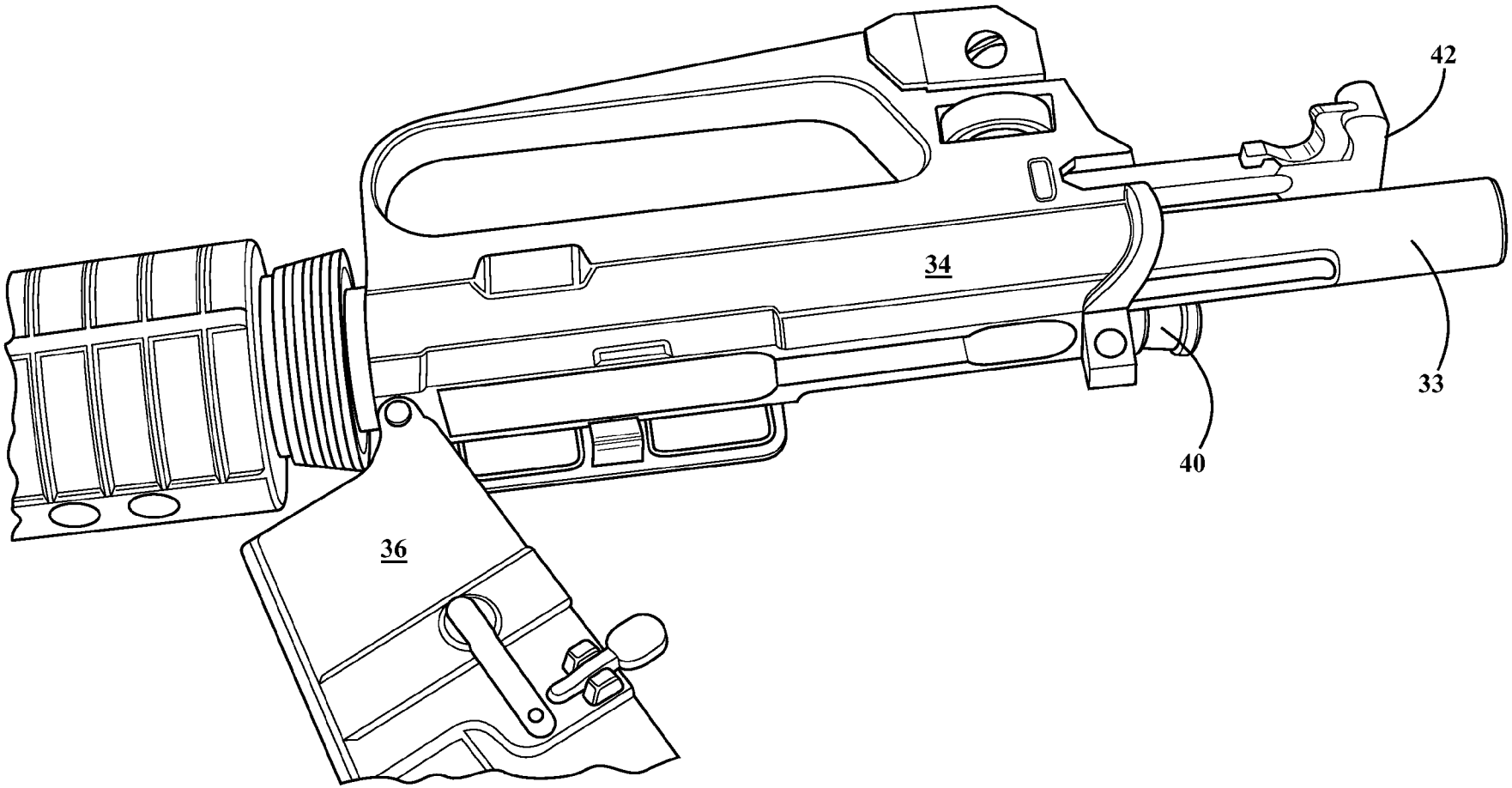
Figure 14:
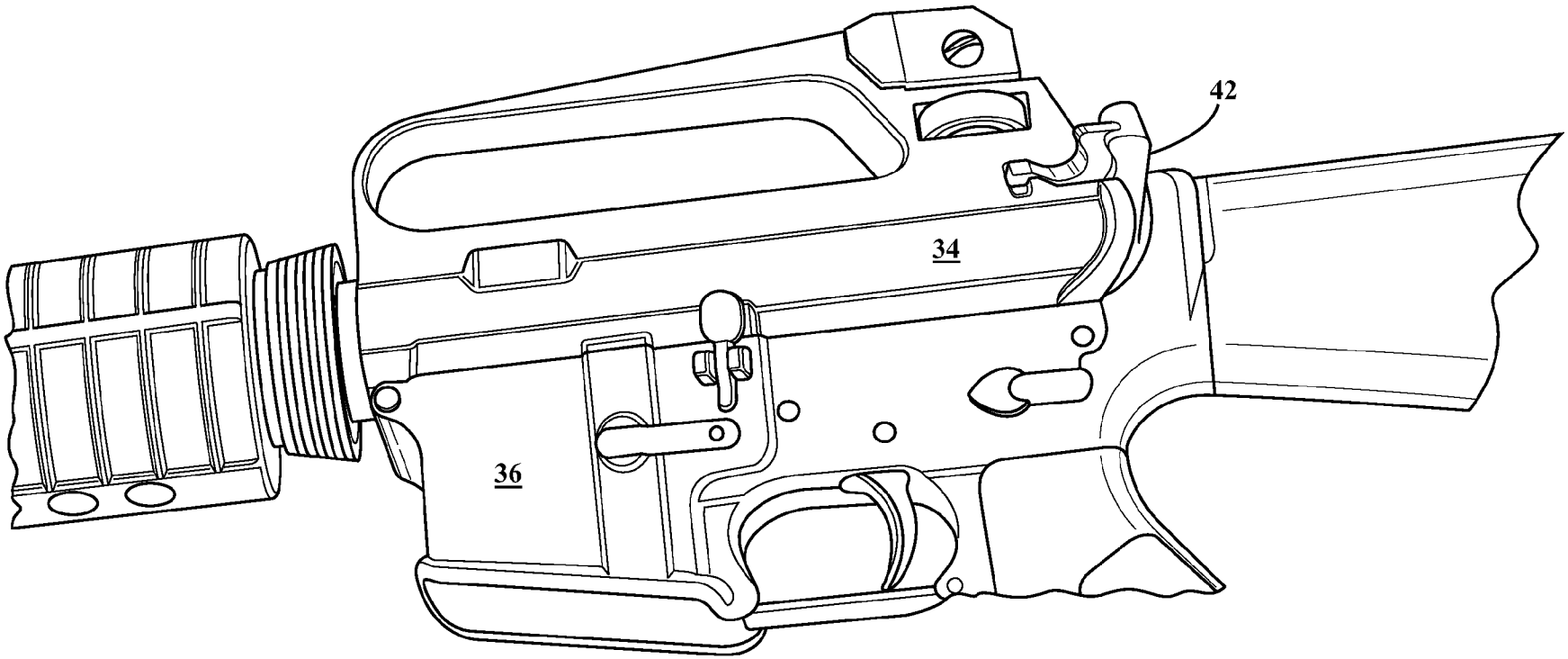

FIGS. 8-14 are also provided as an overall illustrative progression of a succession of environmental views depicting the disassembly of the upper receiver 34 from the lower receiver 36 (see FIG. 8) of an AR-15 style firearm. In particular, FIG. 9 depicts the removal of a conventional bolt assembly (see at 33 in FIG. 9) thus exposing the barrel with extended charging handle 42 (FIG. 10). Subsequent views depict the substitution of the adaptor bolt sub caliber action device (FIGS. 11-13) into the upper receiver barrel, and subsequent reassembly of the upper receiver (FIG. 14).

Figure 15:
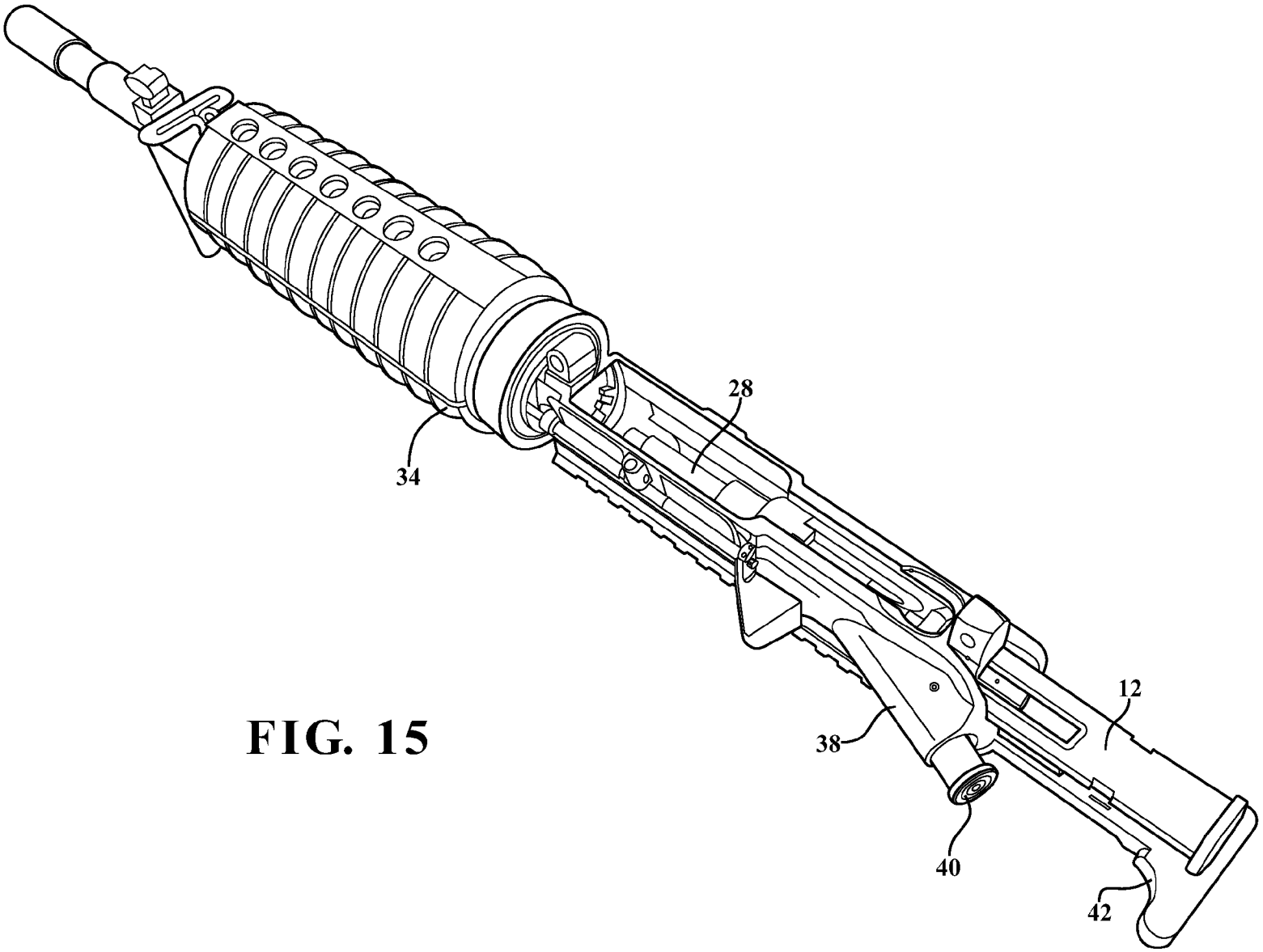
FIG. 15 is an underside exposed perspective of an AR-15 type standard 5.56 upper receiver and exhibiting the installation of the .22 converted adaptor bolt and kit assembly.
Figure 16:
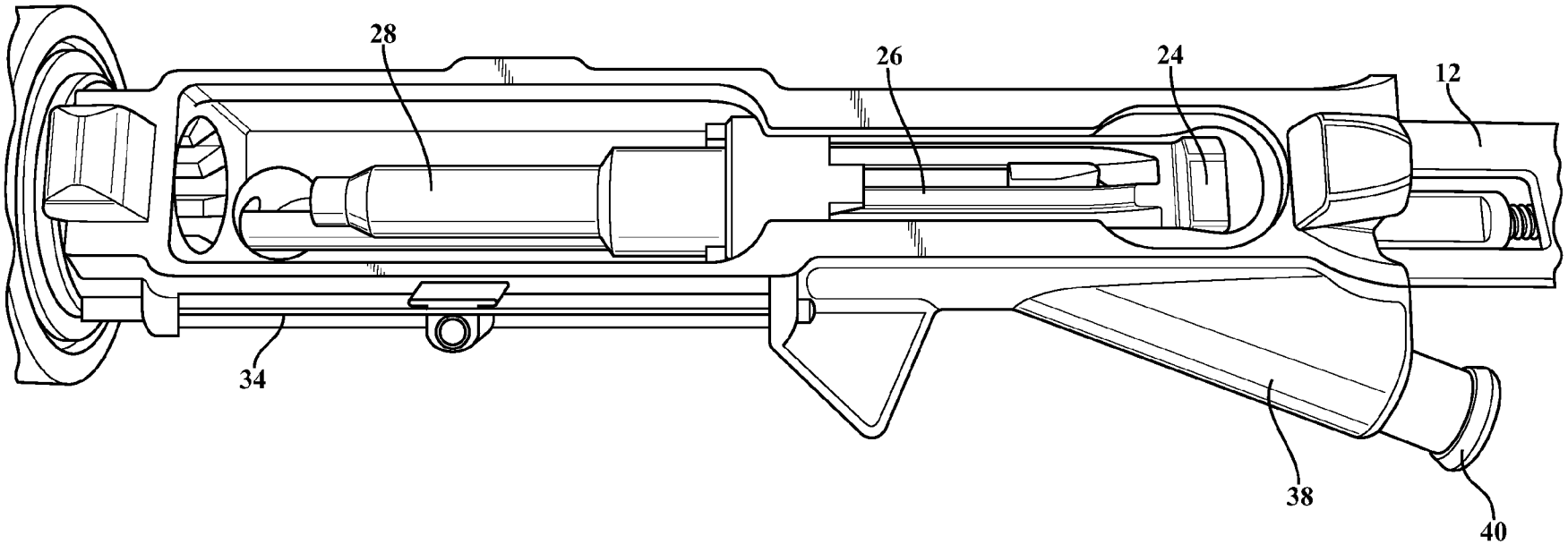
FIG. 16 is a close up illustration of the upper receiver shown in FIG. 15 and better illustration the installation of the modified adaptor bolt in relation to the upper receiver barrel accessible housing and forward assist subassembly integrally formed into the receiver in proximity to the reciprocating adaptor associated with the modified bolt.

As again previously described, FIG. 15 is an underside exposed perspective of an AR-15 type standard 5.56 upper receiver and exhibiting the installation of the .22 converted adaptor bolt and kit assembly, whereas FIG. 16 is a close up illustration of the upper receiver shown in FIG. 15 and better illustrating the installation of the modified adaptor bolt in relation to the upper receiver barrel accessible housing and forward assist subassembly integrally formed into the receiver in proximity to the reciprocating adaptor associated with the modified bolt.

Figure 17:
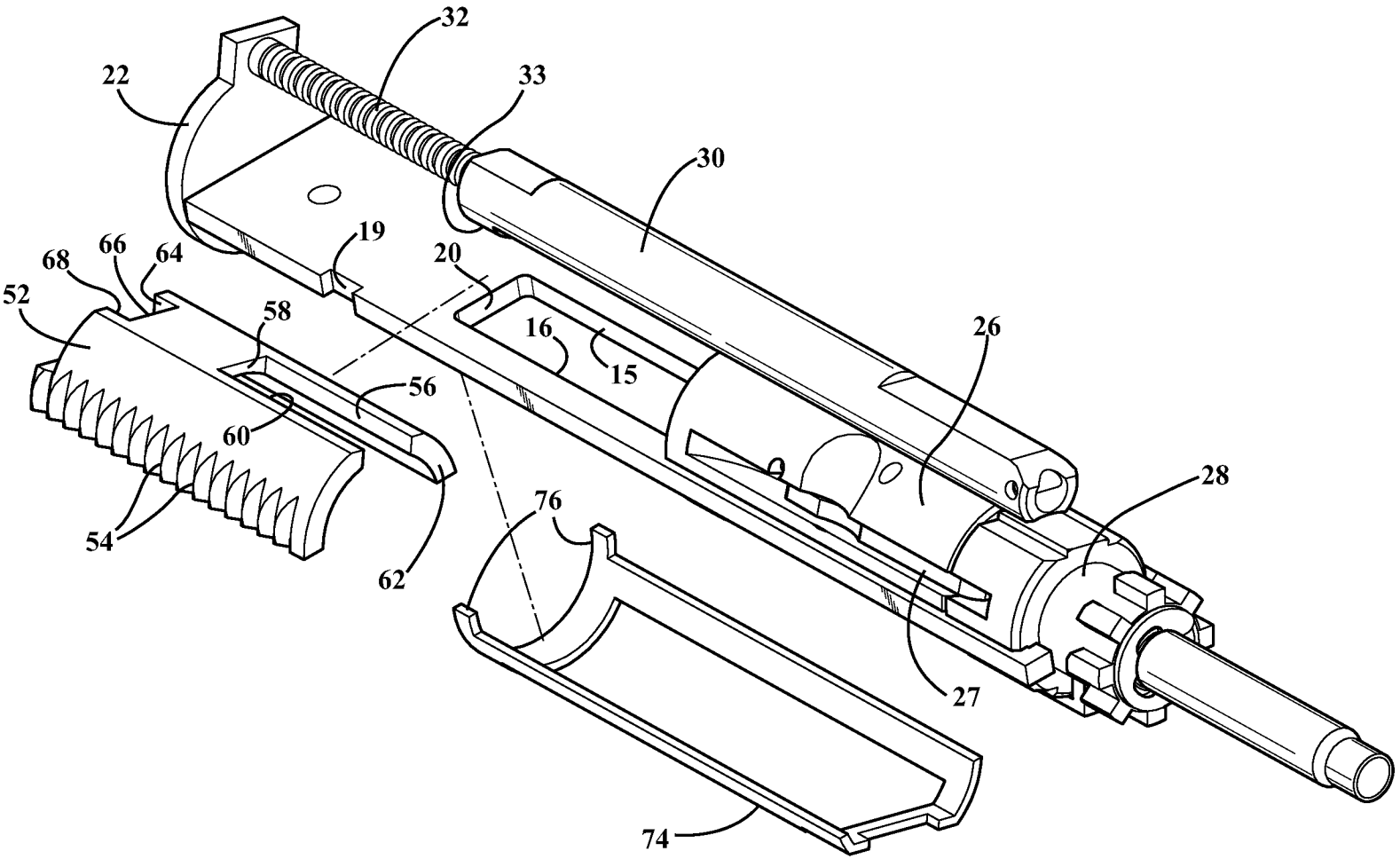
FIG. 17 is an exploded view of a further variant of a forward assist adaptor incorporating a rear slotted location which is in communication with a rearward most underside location of the outer support associated with the main action coil spring and during mounting of the adaptor upon the receiver plate rearwardly of the reciprocating bolt. The adaptor operates as previously disclosed in single and semi automatic firing however, in the event of fully automatic firing, this reconfiguration causes the adaptor to operate as an anti-bounce component by influencing the bolt in a forward closed position to ensure that the associate striking of the hammer against the bolt integrated firing pin.

Referring now to FIG. 17, an exploded view is generally shown at 50 of a further variant of adaptor bolt subassembly and which includes a modified forward assist adaptor 52. The configuration of the bolt assembly 26, receiver plate 12 and forward chamber adaptor 28 is substantially as previously described such that a repetitive description is unnecessary.

The adaptor 52 is configured similar to that shown at 24 in FIG. 3A such as including a plurality of lower edge extending side serrated edges 54, a selected one of which engages a forward most extending portion 46 of the plunger 40 in order to define a displaced position of the adaptor 52 upon the receiver plate 12. The adaptor 52 also exhibits an upper and linear extending slot, see three sided inner linear extending surfaces along a top of the adaptor and as depicted by interconnected inner extending surfaces at 56, 58 and 60 which are communicable from a forward edge 62 of the adaptor 52.

The slotted aspect associated with surfaces 56, 58 and 60 is largely non-functional and is intended to reduce material content associated with the adaptor upon the installation upon the receiver plate 12 and underneath the linear extending sleeve 30. A corresponding rear slotted location associated with the adaptor 52 is further shown at an opposite rear end thereof and includes inner extending surfaces 64, 66 and 68 (contrasting to recess notch location 48 in the adaptor 24 of FIG. 3A). As previously described, the rear defined slot seats the rearward most underside location 33 of the outer sleeve support 30 (such as again welded or otherwise affixed to a top of the reciprocating bolt 26) and associated with the main action coil spring 32.

The adaptor 52 operates as previously disclosed in single and semi automatic firing however, in the event of fully automatic firing, the rear slotted reconfiguration causes the adaptor to operate as an anti-bounce component. This is by virtue of a degree of incremental spacing or play established by the seating of the underside protuberance 33 of the sleeve 30 within the slightly more elongated slot defined by the rear communicating surfaces 64, 66 and 68 of the adaptor 52. In this manner, and during full auto firing, the bolt 26 is influenced in a forward closed position by the adaptor 52 (operating as an anti-bounce element) in order to ensure striking of a hammer (see as schematically depicted at 70 in FIGS. 18B and 18C against the bolt integrated firing pin (see exposed rear convex surface 72 also shown in FIGS. 18B and 18C in contact with the hammer). In operation, the anti-bounce function designed into the adaptor is useful when the weapon operates under full automatic firing mode, and during which the .22 bolt would otherwise tend to bounce open during its repetitive cycling.

The above described functionality of the adaptor in anti-bounce mode is better explained with reference finally to the operating sequence illustrated in FIGS. 18A-18D. Upon assembly of the adaptor 52 upon the upper surface of the receiver plate 12 (FIGS. 18A-18D) and in underside extending fashion relative to the rearward projecting support sleeve, again at 30, the rear slot (shown again by inner recessed and interconnecting surfaces 64, 66 and 68 in FIG. 17 and further depicted in phantom in FIGS. 18B and 18C) is shown in incrementally linearly repositionable fashion relative to the underside projecting protuberance 33 formed at a rear location of the sleeve 30.

Referring again to FIG. 17, an auto trip element 74 is also disclosed and which assembles against and underside of the receiver plate 12 such that a pair of rear and upwardly angled tabs 76 are secured in limited displacing fashion within rear located notched locations 19. The auto trip 74 is held in place with the forward and assist and, upon the bolt being fully closed, is influenced by the adaptor 52 to release the hammer.

Figure 18A:
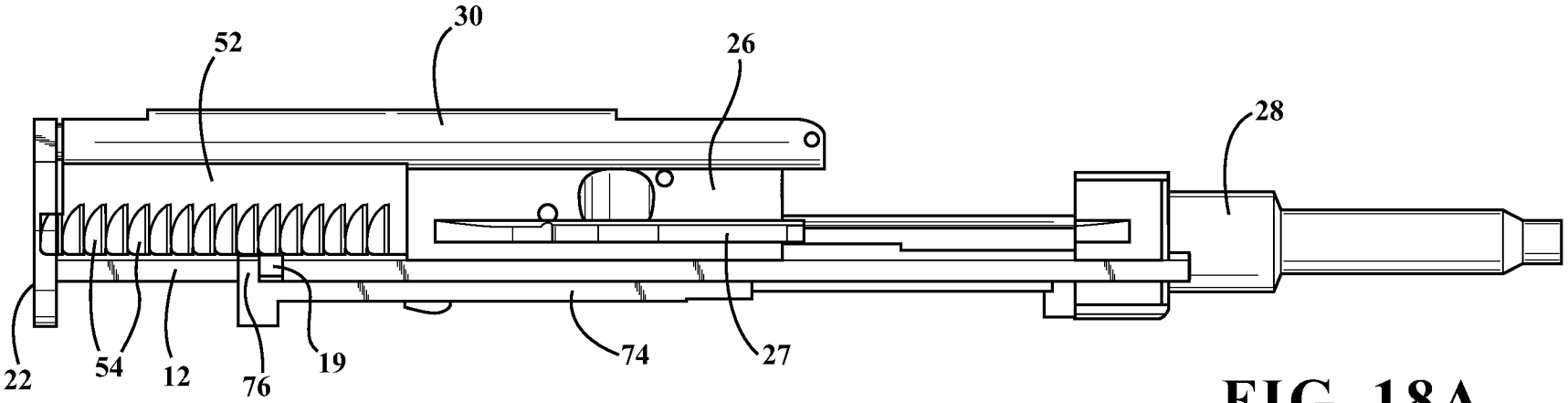
FIGS. 18A-18D illustrate a progression sequence of the action assembly in FIG. 17 and in which an exposed gap existing between the bolt and forward assist adaptor showing the firing pin during fully automatic fire is eliminated due to the forward biasing effect of the adaptor incorporating the anti-bounce feature, thereby maintaining the bolt in a forward-most closed position during contact of the hammer with the firing pin.

Referring again to the progression depicted in FIGS. 18A-18D, the action assembly with forward assist adaptor of FIG. 17 is initially depicted with a gap existing between the bolt 26 and forward assist adaptor 52 (FIGS. 18B and 18C) and which is compensated for by the forward biasing effect of the adaptor 52 (e.g. resulting from forward inertial shifting or travel of the adaptor 52 relative the rearward projecting sleeve 30 over the range of the rear slot in order to maintain the bolt in a forward-most closed position during contact of the hammer 70 with the firing pin 72. With reference first to FIG. 18A, the bolt 26 is illustrated in a rearward most displaced position along with the adaptor 52, the auto trip 74 likewise shown in an incrementally rearward most position.

Figure 18B:
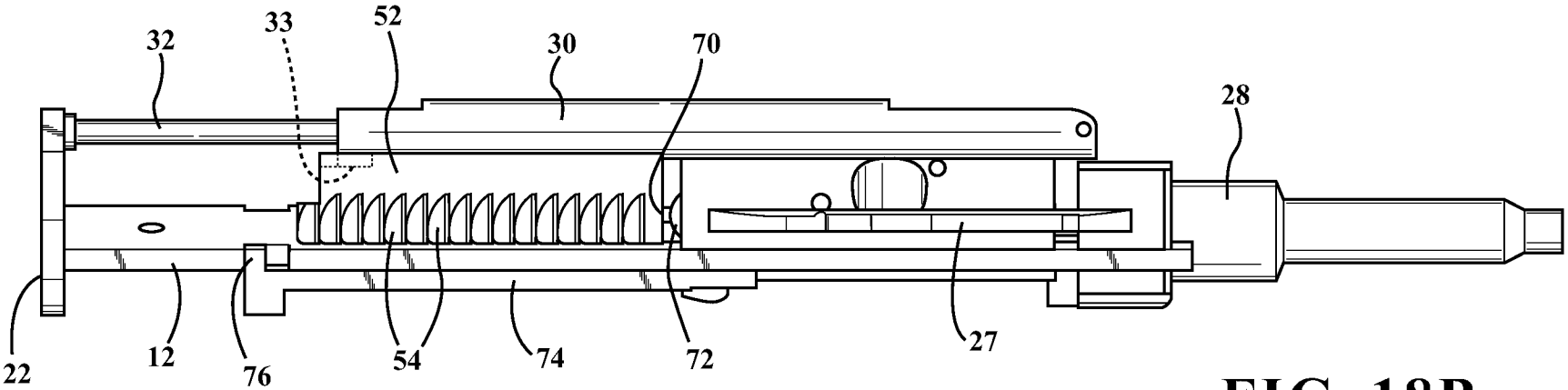
Figure 18C:
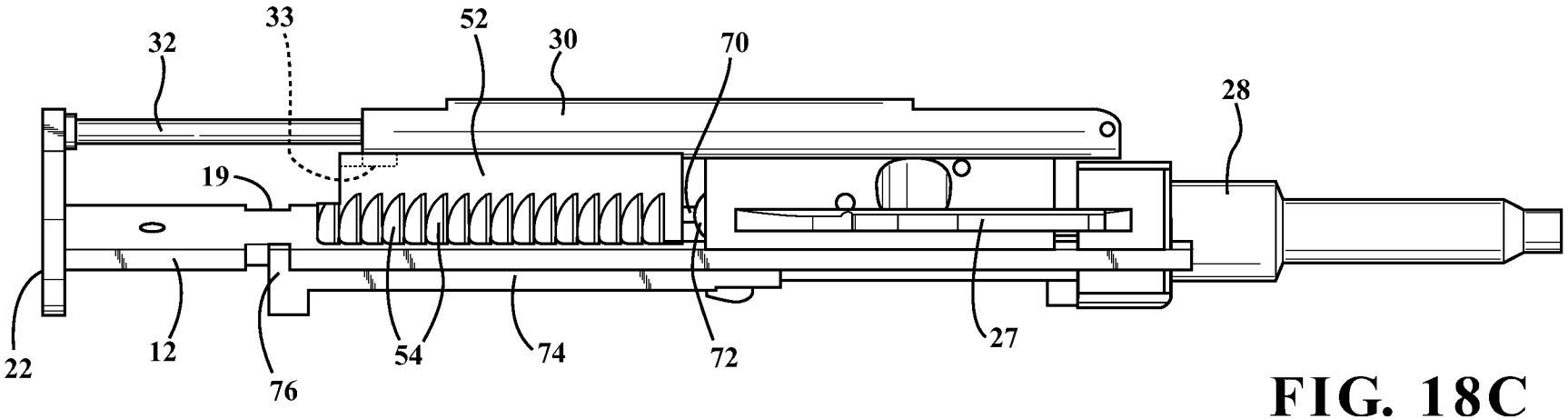
Figure 18D:
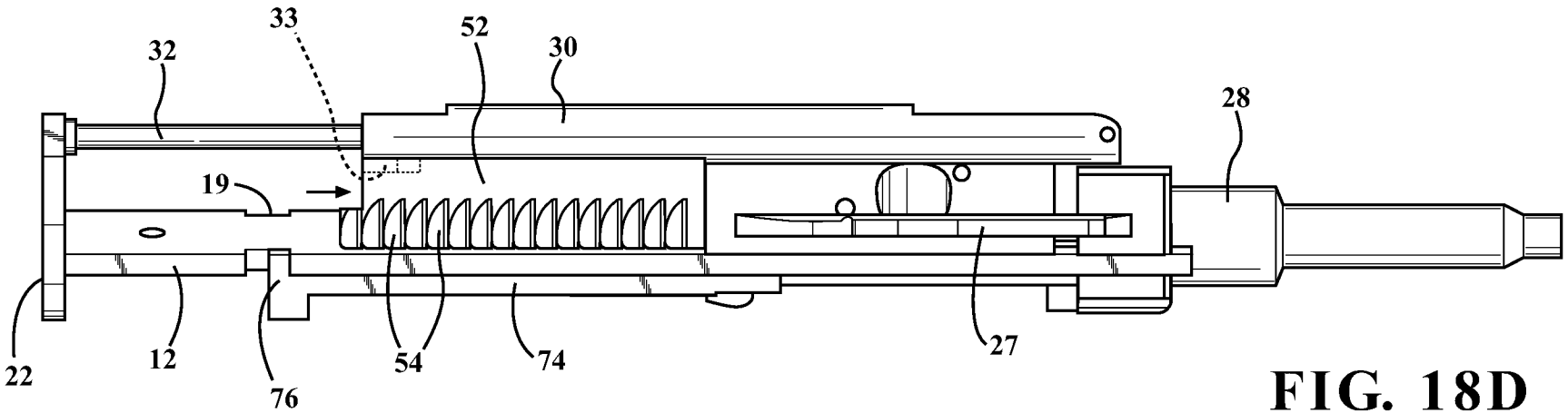

Proceeding to FIG. 18B, and during a subsequent point during a given auto fire cycle, the bolt and adaptor are shown in a substantially forward displaced position, albeit with the forward edge of the bolt not completely engaged with the chamber adaptor. FIG. 18C depicts the forward displacement of the auto trip 74 relative to the notched travel within the receiver plate 12 and, combined with the forward bias of the adaptor 52 in anti-bounce mode, exerts the bolt into a forward engaged position (FIG. 18D). In this manner, the position of the bolt between FIGS. 18C-18D ensures that the hammer 70 is certain to engage the firing pin 72.

Having described my invention, other and additional preferred embodiments will become apparent to those skilled in the art to which it pertains, and without deviating from the scope of the appended claims.

We claim:

1. An action device installable within an upper receiver of an AR-15 type firearm which interfaces with a forward assist mounted in the upper receiver for use with a sub caliber ammunition, comprising:

a receiver plate exhibiting a generally lengthwise extending notched interior established between extending sides;

said notched interior seating a bolt in a forward location and a forward assist adaptor in a rearward abutting location relative to said bolt during reciprocation along said receiver plate between an end-most location and a forward secured chamber adaptor; and said forward assist adaptor having a generally semi-circular cross sectional shape with a plurality of scales along an extending side in communication with a forward engaging pawl of the forward assist.

2. The invention as described in claim 1, said bolt further comprising a rearward projecting support sleeve including an open interior for receiving and seating an opposing guide rod associated with a further mounting location of said receiver plate and in order to maintain in assembled fashion said forward assist adaptor.

3. The invention as described in claim 2, further comprising said adaptor and bolt configured for both drop in (retrofit) and dedicated variations.

4. The invention as described in claim 1, said receiver plate further comprising a plurality of protrusions defined along said notched interior for seating said bolt and said forward assist adaptor.

5. The invention as described in claim 2, said adaptor further comprising a rear communicable slot seating an underside protuberance associated with said sleeve, said adaptor exhibiting a degree of linear travel relative to said sleeve in order to influence the bolt against the chamber adaptor during full auto firing mode.

6. The invention as described in claim 1, further comprising an auto-trip element secured to an underside location of said receiver plate.

7. The invention as described in claim 1, further comprising an end support secured to said receiver plate and exhibiting a side disposed notch for seating a rearward projecting side portion associated with said forward assist adaptor.

8. A sub-caliber action device installable within an upper receiver of an AR-15 type firearm which interfaces with an upper receiver mounted forward assist for use with at least .22 caliber ammunition, comprising:

a generally elongated receiver plate exhibiting a generally lengthwise extending notched interior established between extending sides, said notched interior seating a bolt in a forward reciprocating position and a forward assist adaptor in a rearward contacting and reciprocating fashion along said receiver plate between an end-most location and a forward secured chamber adaptor;

an end support secured to said receiver plate and exhibiting a side disposed notch for seating a rearward projecting side portion associated with said forward assist adaptor;

a rearward projecting support sleeve including an open interior for receiving and seating an opposing guide rod associated with a further mounting location of said receiver plate and in order to maintain in assembled fashion said forward assist adaptor; and said adaptor further comprising a rear communicable slot seating an underside protuberance associated with said sleeve, said adaptor exhibiting a degree of linear travel relative to said sleeve in order to influence the bolt against the chamber adaptor during full auto firing mode.

9. The invention as described in claim 8, said forward assist adaptor further comprising a generally semi-circular cross sectional shape with a plurality of scales along an extending side in communication with a forward engaging pawl of the forward assist.

10. The invention as described in claim 8, further comprising said adaptor and bolt configured for both drop in (retrofit) and dedicated variations.

11. The invention as described in claim 8, said receiver plate further comprising a plurality of protrusions defined along said notched interior for seating said bolt and said forward assist adaptor.

12. The invention as described in claim 8, further comprising an auto-trip element secured to an underside location of said receiver plate.

13. An action device installable within an upper receiver of an AR-15 type firearm which interfaces with a forward assist mounted in the upper receiver for use with a sub caliber ammunition, comprising:

a receiver plate exhibiting a generally lengthwise extending notched interior established between extending sides;

said notched interior seating a bolt in a forward location and a forward assist adaptor in a rearward abutting location relative to said bolt during reciprocation along said receiver plate between an end-most location and a forward secured chamber adaptor; and an end support secured to said receiver plate and exhibiting a side disposed notch for seating a rearward projecting side portion associated with said forward assist adaptor.

14. A sub-caliber action device installable within an upper receiver of an AR-15 type firearm which interfaces with an upper receiver mounted forward assist for use with at least .22 caliber ammunition, comprising:

a generally elongated receiver plate exhibiting a generally lengthwise extending notched interior established between extending sides, said notched interior seating a bolt in a forward reciprocating position and a forward assist adaptor in a rearward contacting and reciprocating fashion along said receiver plate between an end-most location and a forward secured chamber adaptor, said adaptor having a generally semi-circular cross sectional shape with a plurality of scales along an extending side in communication with a forward engaging pawl of the forward assist;

a rearward projecting support sleeve including an open interior for receiving and seating an opposing guide rod associated with a further mounting location of said receiver plate and in order to maintain in assembled fashion said forward assist adaptor; and said adaptor further comprising a rear communicable slot seating an underside protuberance associated with said sleeve, said adaptor exhibiting a degree of linear travel relative to said sleeve in order to influence the bolt against the chamber adaptor during full auto firing mode.

* * * * *